US011794469B2

(12) United States Patent
Tanaka

(10) Patent No.: US 11,794,469 B2
(45) Date of Patent: Oct. 24, 2023

(54) IMAGE FORMING APPARATUS

(71) Applicant: FUJIFILM Business Innovation Corp., Tokyo (JP)

(72) Inventor: Kei Tanaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 162 days.

(21) Appl. No.: 17/308,312

(22) Filed: May 5, 2021

(65) Prior Publication Data

US 2022/0107595 A1 Apr. 7, 2022

(30) Foreign Application Priority Data

Oct. 2, 2020 (JP) ..... 2020-167883

(51) Int. Cl.

*G03G 15/00* (2006.01)
*B41F 21/08* (2006.01)
*B65H 29/04* (2006.01)

(52) U.S. Cl.

CPC ..... *B41F 21/08* (2013.01); *B65H 29/044* (2013.01); *G03G 2215/0164* (2013.01)

(58) Field of Classification Search

CPC ..... B41F 21/08; B65H 29/044; B65H 5/085; G03G 2215/0164

See application file for complete search history.

(56) References Cited

U.S. PATENT DOCUMENTS 4,746,007 A * 5/1988 Houseman ..... B65G 17/323 198/470.1
5,125,334 A * 6/1992 Marx ..... B41F 21/08 101/183

(Continued)

FOREIGN PATENT DOCUMENTS

JP 2001-310444 A 11/2001

*Primary Examiner* — Jennifer Bahls
*Assistant Examiner* — Quang X Nguyen
(74) *Attorney, Agent, or Firm* — Sughrue Mion, PLLC

(57) ABSTRACT

An image forming apparatus includes: a rotating body having a recess in an outer peripheral surface thereof; a sprocket provided coaxially with the rotating body to rotate integrally with the rotating body; a chain having plural links, the chain being wound around the sprocket to circulate in a circulating direction so as to shift from a rotary movement in which the chain rotates in an arc shape conforming to an outer periphery of the sprocket along with the sprocket, to a linear movement; a holder fixed to at least one link of the links of the chain, the holder being configured to hold a leading end portion of a recording medium, the holder being configured to transport the recording medium by performing the rotary movement along with the rotating body and the chain in a state of (i) holding the leading end portion of the recording medium placed on the outer peripheral surface of the rotating body and (ii) being located in the recess, and then shifting to the linear movement along with the chain; and an image forming unit configured to form an image on the recording medium placed on the outer peripheral surface of the rotating body, in which a holding position where the holder holds the recording medium is arranged downstream of an upstream roller of rollers of a most downstream link in the circulating direction among the at least one link to which the holder is fixed.

19 Claims, 12 Drawing Sheets

(56) References Cited

U.S. PATENT DOCUMENTS

| | | | | |
|---|---|---|---|---|
| 5,380,000 | A * | 1/1995 | Ohno | B65H 29/003 101/410 |
| 5,590,598 | A * | 1/1997 | Keller | B41F 31/302 101/352.04 |
| 6,641,133 | B2 * | 11/2003 | Mutschall | B65H 29/585 271/204 |
| 2001/0051063 | A1 | 12/2001 | Okamoto et al. | |

* cited by examiner

IMAGE FORMING APPARATUS

CROSS-REFERENCE TO RELATED APPLICATIONS

This application is based on and claims priority under 35 USC 119 from Japanese Patent Application No. 2020-167883 filed Oct. 2, 2020.

BACKGROUND

(i) Technical Field

The present disclosure relates to an image forming apparatus.

(ii) Related Art

JP-A-2001-310444 discloses a printing apparatus including at least one image carrier, an intermediate transfer body provided opposite the image carrier so that an image formed on the image carrier is transferred to the intermediate transfer body, and a sheet transport device that transports a printing sheet to which the image retained on the intermediate transfer body is to be transferred. In the printing device, the sheet transport device includes a chain which extends between toothed pulleys and is rotationally driven to travel in a transfer region directly below the intermediate transfer body from upstream to downstream thereof and a pawl member which is fixed to the chain and holds the printing sheet fed from a paper feeding position upstream of the transfer region.

SUMMARY

Consider an image forming apparatus including a rotating body having a recess in an outer peripheral surface thereof, a sprocket provided coaxially with the rotating body to rotate integrally with the rotating body, a chain having plural links and wound around the sprocket, a holder that is fixed to at least one link of links of the chain and that is configured to hold a leading end portion of a recording medium, and an image forming unit.

In the image forming apparatus, for example, the chain circulates in a circulating direction so as to shift from a rotary movement in which the chain rotates in an arc shape conforming to an outer periphery of the sprocket along with the sprocket, to a linear movement. The holder transports the recording medium in the following manner. That is, the holder enters the recess in a state of holding the leading end portion of the recording medium placed on the outer peripheral surface of the rotating body, performs the rotary movement along with the rotating body and the chain, and thereafter, shifts to the linear movement along with the chain. Then, the image forming unit forms an image on the recording medium placed on the outer peripheral surface of the rotating body.

Here, further consider the image forming apparatus having such a configuration that a holding position where the holder holds the recording medium is arranged upstream of an upstream roller of rollers of the most downstream link in the circulating direction among the at least one link to which the holder is fixed. In this configuration, when the holder shifts from the rotary movement to the linear movement, the holder may pull the recording medium having the leading end portion held therein, thereby moving the recording medium relative to the outer peripheral surface of the rotating body, which may cause image distortion.

Aspects of non-limiting embodiments of the present disclosure relate to prevent image distortion as compared with a configuration in which the holding position where the holder holds the recording medium is arranged upstream of the upstream roller of the rollers of the most downstream link in the circulating direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus includes: a rotating body having a recess in an outer peripheral surface thereof; a sprocket provided coaxially with the rotating body to rotate integrally with the rotating body; a chain having plural links, the chain being wound around the sprocket to circulate in a circulating direction so as to shift from a rotary movement in which the chain rotates in an arc shape conforming to an outer periphery of the sprocket along with the sprocket, to a linear movement; a holder fixed to at least one link of the links of the chain, the holder being configured to hold a leading end portion of a recording medium, the holder being configured to transport the recording medium by performing the rotary movement along with the rotating body and the chain in a state of (i) holding the leading end portion of the recording medium placed on the outer peripheral surface of the rotating body and (ii) being located in the recess, and then shifting to the linear movement along with the chain; and an image forming unit configured to form an image on the recording medium placed on the outer peripheral surface of the rotating body, in which a holding position where the holder holds the recording medium is arranged downstream of an upstream roller of rollers of a most downstream link in the circulating direction among the at least one link to which the holder is fixed.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments according to the present disclosure will be described by way of example with reference to the accompanying drawings.

First Exemplary Embodiment

Image Forming Apparatus 10

Figure 1:
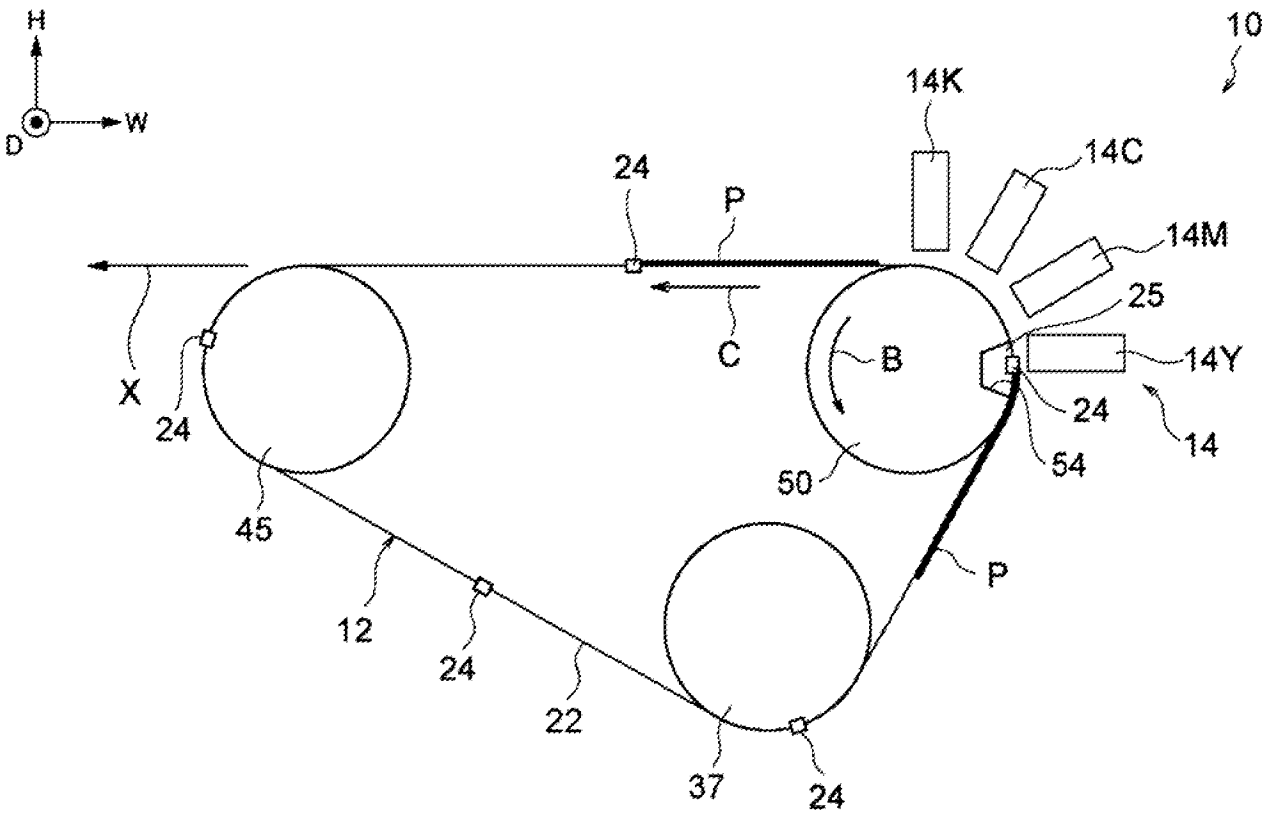
FIG. 1 is a schematic view illustrating a configuration of an image forming apparatus according to a first exemplary embodiment.

First, a configuration of an image forming apparatus 10 according to a first exemplary embodiment will be described. FIG. 1 is a schematic view illustrating a configuration of the image forming apparatus 10 according to the present exemplary embodiment. An arrow H illustrated in each drawing indicates an apparatus height direction which is a vertical direction, an arrow W indicates an apparatus width direction which is a horizontal direction, and an arrow D indicates an apparatus depth direction (apparatus front to rear direction) which is the horizontal direction. Dimensional ratios in the H direction, the W direction, and the D direction of respective parts illustrated in each drawing may be different from actual dimensional ratios.

The image forming apparatus 10 illustrated in FIG. 1 is an inkjet type image forming apparatus that forms an ink image (an example of an image) on a recording medium P. Specifically, the image forming apparatus 10 includes an image forming unit 14 and a transport mechanism 12. Specifically, each part (image forming unit 14 and the transport mechanism 12) of the image forming apparatus 10 will be described.

Image Forming Unit 14

The image forming unit 14 has a function of forming an ink image on the recording medium P that is being transported. Specifically, as illustrated in FIG. 1, the image forming unit 14 includes ejection units 14Y, 14M, 14C, and 14K (hereinafter, which may be collectively referred to as "14Y to 14K") which eject an ink to a predetermined ejection position.

The ejection units 14Y to 14K are arranged in this order toward the downstream side in the transport direction of the recording medium P. Further, the ejection units 14Y to 14K have a length along the width direction of the recording medium P. The width direction of the recording medium P is a direction intersecting with the transport direction (specifically, a direction orthogonal to the transport direction), and is a direction along the apparatus front to rear direction.

Then, in the image forming unit 14, the ejection units 14Y to 14K eject ink droplets onto the recording medium P that is being transported by the transport mechanism 12 in a known manner such as a thermal manner or a piezoelectric method to form an ink image on the recording medium P.

Transport Mechanism 12

Figure 2:
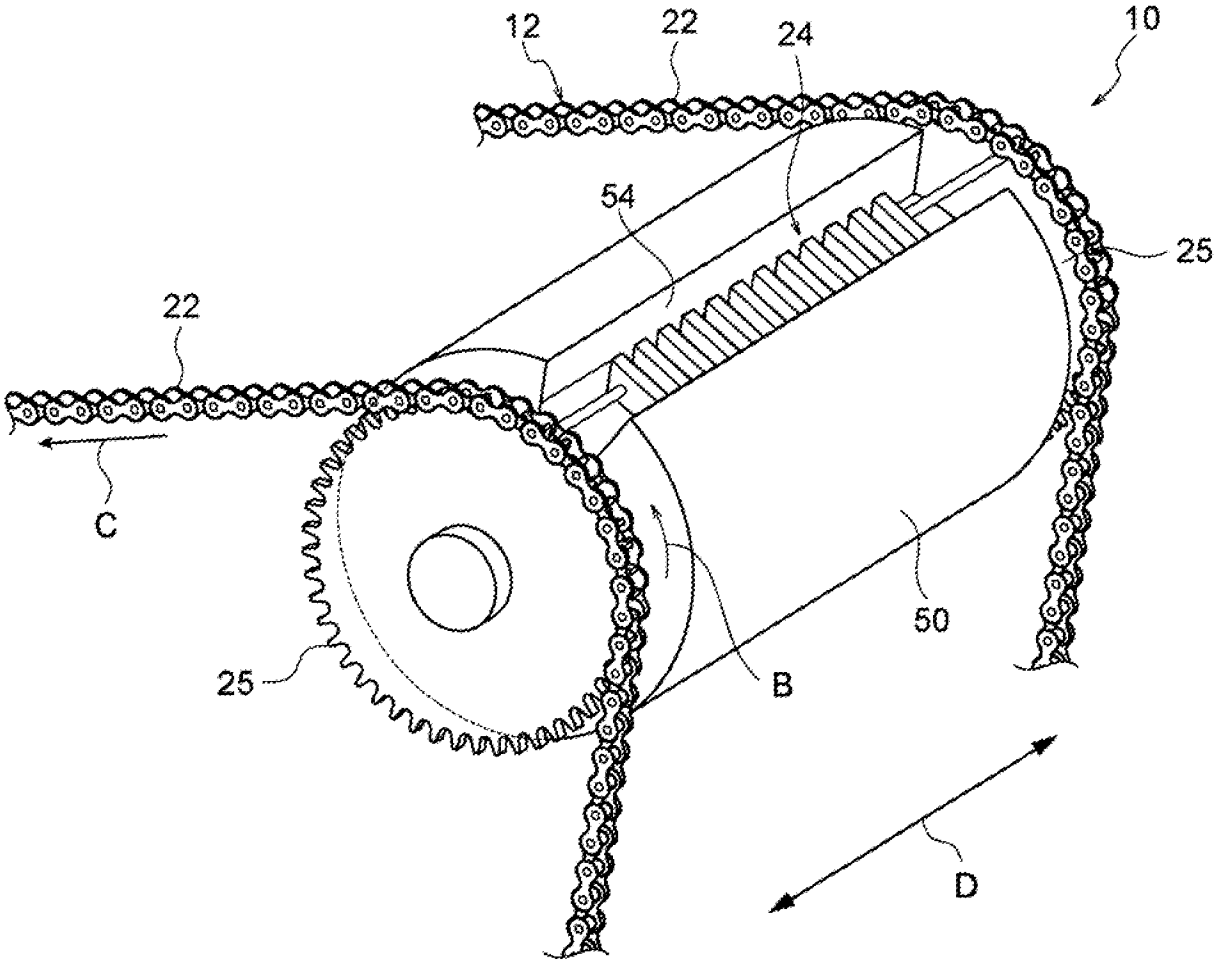
FIG. 2 is a perspective view illustrating a configuration around a rotating body according to the first exemplary embodiment.

The transport mechanism 12 illustrated in FIG. 1 is a mechanism that transports the recording medium P. As illustrated in FIGS. 1 and 2, the transport mechanism 12 includes a rotating body 50, a pair of chains 22, and a gripper 24. FIG. 1 illustrates one of the pair of chains 22, and also illustrates the chain 22 and the gripper 24 in a simplified manner. Further, FIG. 2 illustrates the gripper 24 in a simplified manner.

As illustrated in FIG. 1, the rotating body 50 is opposite the ejection units 14Y to 14K. The rotating body 50 is formed in a circular shape in a side view and has a recess 54 in the outer peripheral surface thereof. This recess 54 is provided one in a part of the outer peripheral surface of the rotating body 50 in the peripheral direction. Furthermore, the recess 54 is elongated along the axial direction of the rotating body 50, and has a depth along the radial direction of the rotating body 50.

As illustrated in FIG. 2, a pair of sprockets 25 are provided on both end sides of the rotating body 50 in the axial direction. The pair of sprockets 25 are arranged coaxially with the rotating body 50, and are configured to rotate integrally with the rotating body 50. The rotating body 50 and the pair of sprockets 25 are rotationally driven by a drive unit (not illustrated). In the following, the axial direction of the rotating body 50 may be simply expressed as "axial direction".

As illustrated in FIG. 1, a pair of sprockets 45 are arranged on one side of the pair of sprockets 25 in the apparatus width direction (the left side in FIG. 1 and the downstream side in the transport direction). The pair of sprockets 45 are arranged at an interval in the apparatus depth direction.

Further, a pair of sprockets 37 are arranged on the lower side of the pair of sprockets 25 and the pair of sprockets 45. The pair of sprockets 37 are closer in the apparatus width direction to the pair of sprockets 25 than the pair of sprockets 45 (more specifically, the pair of sprockets 37 are located on the right side of the pair of sprockets 45). The pair of sprockets 37 are arranged at an interval in the apparatus depth direction. FIG. 1 illustrates one of the pair of sprockets 25, one of the pair of sprockets 37, and one of the pair of sprockets 45.

As illustrated in FIG. 1, the pair of chains 22 are formed in an annular shape. As illustrated in FIG. 2, the pair of chains 22 are arranged at an interval in the apparatus depth direction (the D direction in the drawing). Each of the pair of chains 22 is wound around each of the pair of sprockets 25, each of the pair of sprockets 37 (see FIG. 1), and each of the pair of sprockets 45 (see FIG. 1). Then, the rotating body 50 and the pair of sprockets 25 are integrally driven to rotate in the rotation direction B (the direction of the arrow B), so that the chain 22 circulates in the circulating direction C (the direction of the arrow C). Specifically, the chain 22 circulates in the circulating direction C so as to shift from a rotary movement in which the chain 22 rotates along with each of the sprockets 25, 45, and 37 in an arc shape conforming to the outer periphery of each of the sprockets 25, 45, and 37 to a linear movement. In following, the upstream side of the circulating direction C of the chain 22 may be simply referred to as "upstream", and the downstream side of the circulating direction C of the chain 22 may be simply referred to as "downstream".

Figure 3:
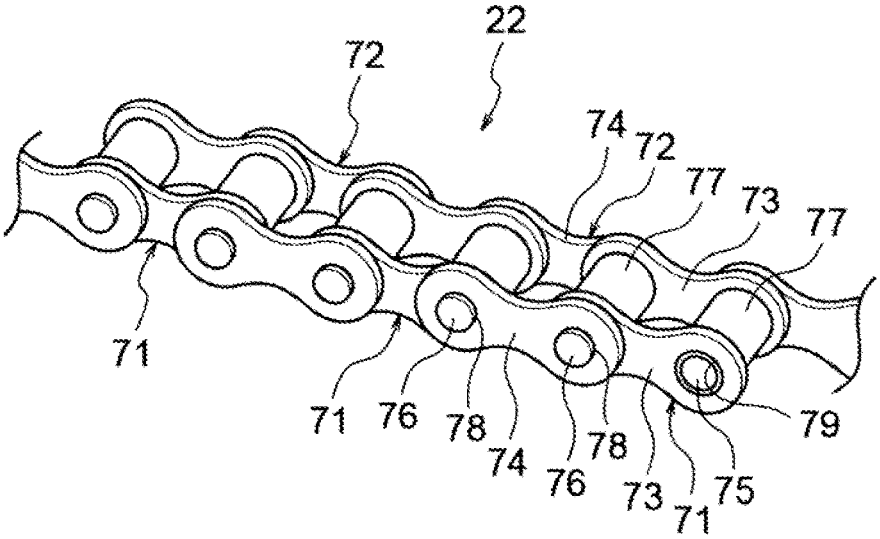
FIG. 3 is a perspective view illustrating a chain according to the first exemplary embodiment.

As illustrated in FIG. 3, the chain 22 is configured by alternately connecting plural inner links 71 and plural outer links 72. The inner link 71 includes two inner plates 73, two bushes 75, and two rollers 77. The two bushes 75 are press-fitted into two holes 79 formed in the two inner plates 73. The two rollers 77 are rotatably supported at the outer periphery thereof on the two bushes 75. The outer link 72 includes two outer plates 74 and two pins 76. The two pins 76 are press-fitted into two holes 78 formed in the two outer plates 74. In the chain 22, the bush 75 is arranged on the outer peripheral side of the pin 76, and the roller 77 is arranged on the outer peripheral side of the bush 75. The inner link 71 and the outer link 72 are an example of links.

Figure 4:
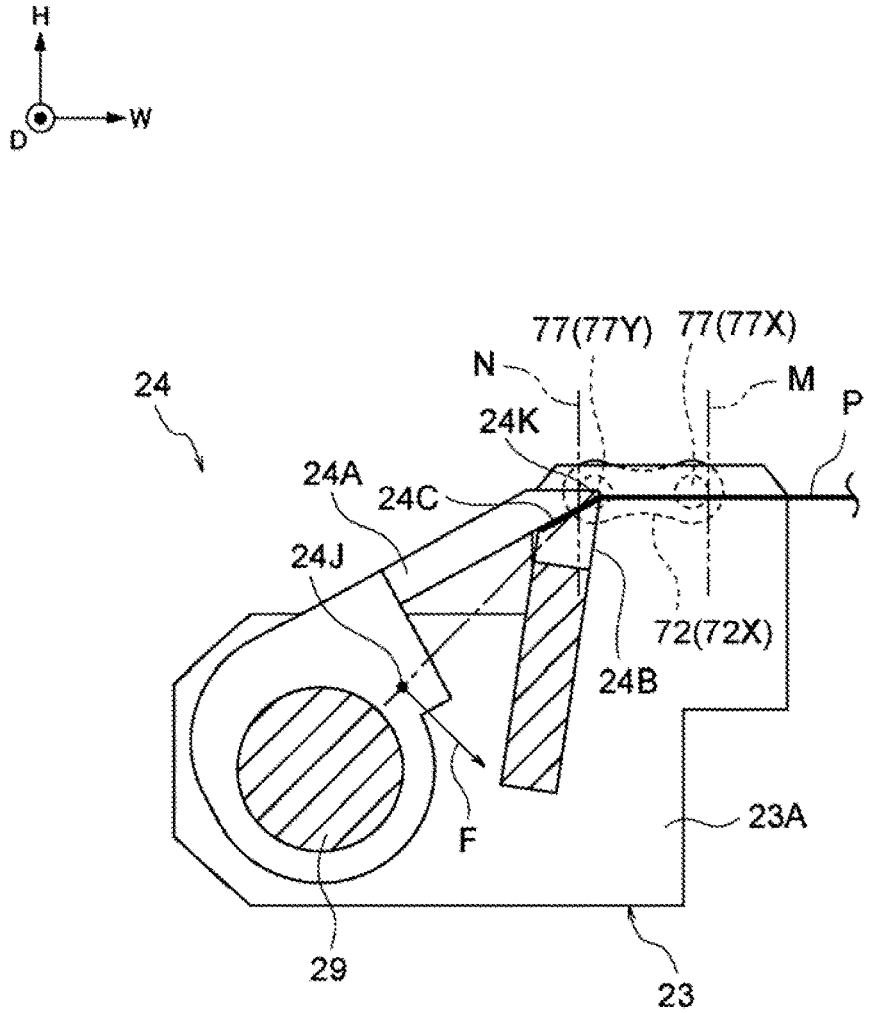
FIG. 4 is a side sectional view illustrating a gripper according to the first exemplary embodiment.

As illustrated in FIG. 4, the gripper 24 functions as a holder that holds a leading end portion of the recording medium P. The gripper 24 includes a fixing member 23, a pawl 24A, a pawl base 24B, and a shaft 29.

Figure 5:
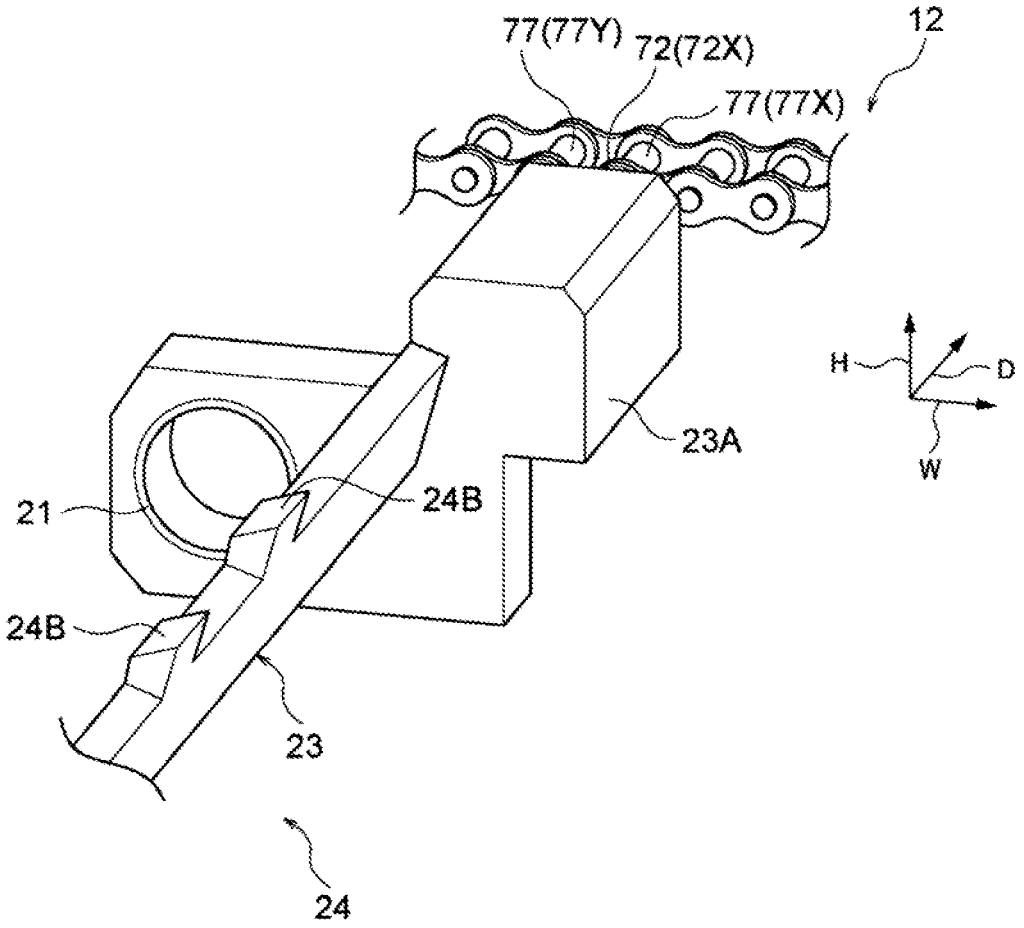
FIG. 5 is a perspective view illustrating a fixing member for the gripper and the chain according to the first exemplary embodiment.

The fixing member 23 is arranged from one to the other of the pair of chains 22, and has a length along the apparatus depth direction (that is, the axial direction of the rotating body 50) (see FIG. 5). As illustrated in FIGS. 4 and 5, the fixing member 23 is provided at one end and the other end thereof in the longitudinal direction with fixing portions 23A which are fixed to the chains 22. Specifically, the top of the fixing portion 23A is fixed to a single outer link 72 in the chain 22. That is, the gripper 24 is fixed to the single outer link 72 by the fixing member 23.

In FIG. 5, although the fixing portion 23A arranged at one end of the fixing member 23 in the longitudinal direction is illustrated, the fixing portion 23A is also arranged horizontally symmetrically at the other end of the fixing member 23 in the longitudinal direction, and this fixing portion 23A is similarly fixed to the other chain 22.

In the present exemplary embodiment, plural fixing members 23 are arranged at an interval along the circulating direction C of the chain 22, and each of the plural fixing members 23 is fixed to the pair of chains 22 by the fixing portions 23A.

Furthermore, a bearing 21 is provided in each fixing portion 23A to rotatably support the shaft 29 (see FIG. 4) (see FIG. 5). The shaft 29 is arranged from one to the other of the two fixing portions 23A, and has a length along the apparatus depth direction (that is, the axial direction of the rotating body 50). Each of one end and the other end of the shaft 29 in the longitudinal direction is rotatably supported by the bearing 21.

The plural pawls 24A are fixed to the shaft 29 along the axial direction thereof, and the pawls 24A and the shaft 29 rotate integrally. As illustrated in FIG. 4, the gripper 24 holds the recording medium P by sandwiching the leading end portion of the recording medium P between the pawl 24A and the pawl base 24B. In the gripper 24, for example, the pawl 24A is pressed against the pawl base 24B by a spring, and the pawl 24A is opened from and closed to the pawl base 24B by the action of a cam.

The transport mechanism 12 holds the leading end portion of the recording medium P, which is sent from an accommodating unit (not illustrated) that accommodates recording media P, by the gripper 24, upstream of the ejection position of the ejection units 14Y to 14K, as illustrated in FIG. 4. Further, as the chain 22 circulates, the gripper 24 holding the leading end portion of the recording medium P moves in an arc shape along the outer periphery of the sprocket 25 and the rotating body 50 (see FIG. 1). Thus, the recording medium P is placed on the outer peripheral surface of the rotating body 50.

Then, the gripper 24 transports the recording medium by (a) performing a rotary movement along with the sprocket 25, the rotating body 50, and the chain 22 in a state of (i) holding the leading end portion of the recording medium P placed on the outer peripheral surface of the rotating body 50 and (ii) being located in the recess 54, and thereafter, (b) shifting to a linear movement along with the chain 22. Thus, an image is formed as the recording medium P passes through the ejection position of the ejection units 14Y to 14K and ink droplets are ejected from the ejection units 14Y to 14K to the recording medium P placed on the outer peripheral surface of the rotating body 50.

Here, in the present exemplary embodiment, as illustrated in FIG. 4, a holding position 24K where the gripper 24 holds the recording medium P (hereinafter, simply referred to as a "holding position 24K") is arranged downstream of an upstream roller 77 (hereinafter referred to as an "upstream roller 77X") of the rollers 77 of the outer link 72 (hereinafter referred to as a "fixing link 72X") to which the gripper 24 is fixed.

The holding position 24K is a position where the gripper 24 holds the recording medium P, and is specifically a position where the recording medium P is sandwiched between the pawl 24A and the pawl base 24B of the gripper 24. In other words, the holding position 24K may be said to be a position where sandwiching surfaces 24C of the pawl 24A and the pawl base 24B which sandwich the recording medium P therebetween are arranged with the recording medium P therebetween. At least a part of the holding position 24K may only have to be arranged downstream of the upstream roller 77X of the fixing link 72X.

Further, the fixing link 72X is an example of a "most downstream link in the circulating direction C among at least one link to which the gripper 24 is fixed". In the present exemplary embodiment, since the at least one link to which the gripper 24 is fixed is no more than one link, this link is the most downstream link in the circulating direction C.

The upstream roller 77X of the fixing link 72X refers to a roller 77 arranged on an outer peripheral side of an upstream pin 76 of the two pins 76 provided in the fixing link 72X.

The phrase "something is arranged downstream of the upstream roller 77X" is a concept including a case where the thing of interest is arranged at an arrangement position where the upstream roller 77X is arranged. Thus, the holding position 24K may only have to be arranged downstream of the upstream end of the upstream roller 77X in the circulating direction C. That is, the holding position 24K may only have to be arranged downstream of a double chain line M in FIG. 4 (which is a line that is perpendicular to the circulating direction C and that passes through the upstream end of the upstream roller 77X).

Further, the holding position 24K may be offset from the chain 22 in a direction perpendicular to the circulating direction C when viewed in the axial direction of the upstream roller 77X. That is, the holding position 24K does not need to overlap with the chain 22 when viewed in the axial direction of the upstream roller 77X.

In the present exemplary embodiment, specifically, the holding position 24K is arranged in a region extending from the upstream roller 77X of the fixing link 72X to a downstream roller 77 (hereinafter, referred to as a "downstream roller 77Y") of the rollers of the fixing link 72X in the circulating direction C.

The phrase "something is arranged in a region extending from the upstream roller 77X to the downstream roller 77Y" is a concept including (i) a case where the thing of interest is arranged at the arrangement position where the upstream roller 77X is arranged and (ii) a case where the thing of interest is arranged at the arrangement position where the downstream roller 77Y is arranged. Thus, the holding position 24K may only have to be arranged between the upstream end of the upstream roller 77X and the downstream end of the downstream roller 77Y in the circulating direction C. That is, the holding position 24K may only have to be arranged between the double chain line M and a double chain line N (which is a line that is perpendicular to the circulating direction C and that passes through the downstream end of the downstream roller 77Y) in FIG. 4.

In the present exemplary embodiment, more specifically, the holding position 24K is arranged inside the outer edge of the downstream roller 77Y when viewed in the axial direction. That is, the holding position 24K overlaps with at least one of the downstream roller 77Y, the bush 75 arranged inside the downstream roller 77Y, or the pin 76 arranged inside the downstream roller 77Y when viewed in the axial direction (see FIG. 4).

Guide Unit 60

Figure 6:
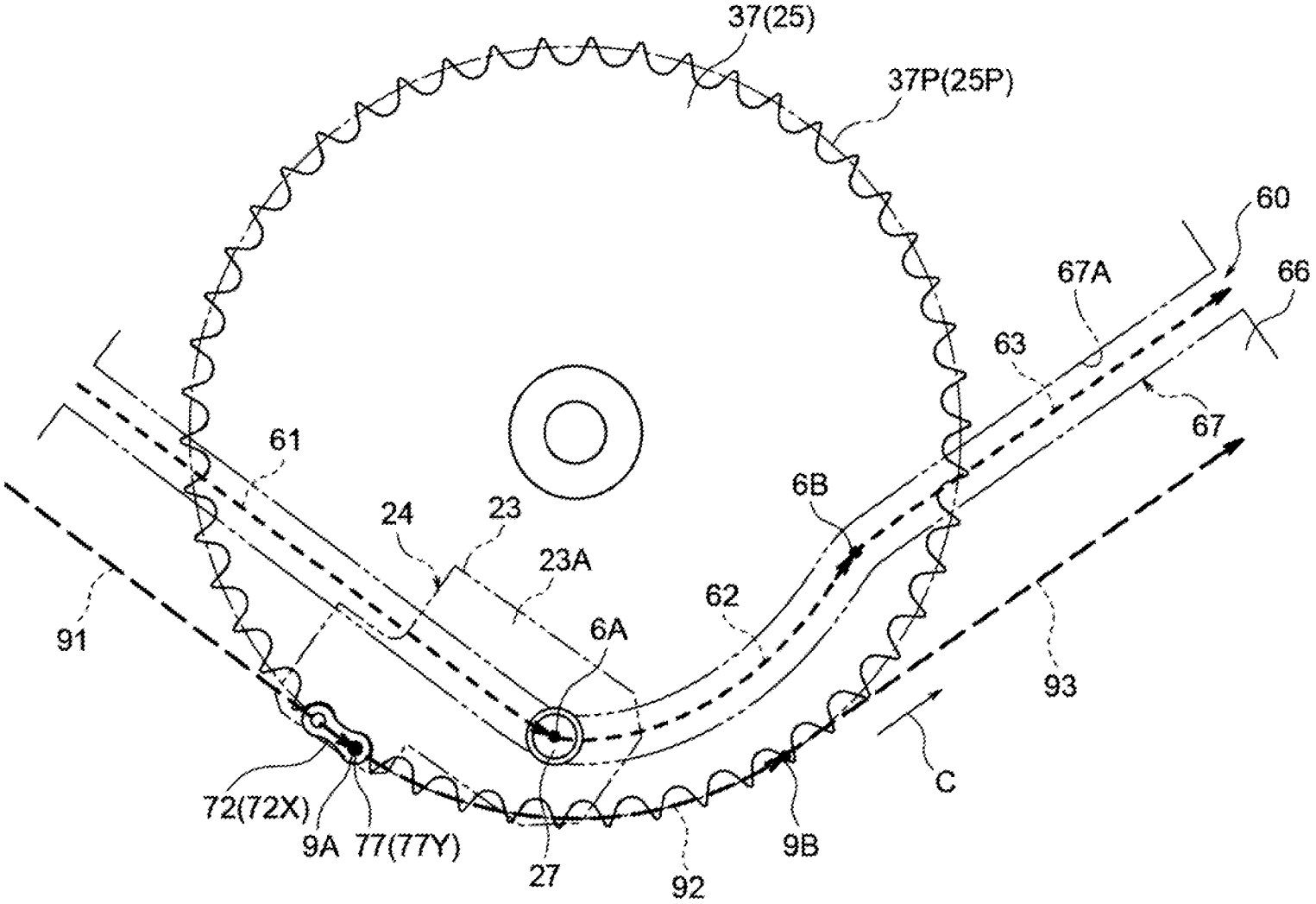
FIG. 6 is a side view illustrating a guide unit according to the first exemplary embodiment.

As illustrated in FIG. 6, the transport mechanism 12 further includes a guide unit 60 which guides the gripper 24. The guide unit 60 has a guide groove 67 formed in a side wall 66 arranged on the lateral side in the axial direction with respect to each of the fixing portions 23A arranged at one end and the other end of the fixing member 23 (see FIG. 5) in the longitudinal direction. The guide groove 67 guides a guided roll 27 as a guided portion coaxially provided at either of one end and the other end of the shaft 29 in the axial direction. Specifically, the guided roll 27 is inserted into the guide groove 67 and a guide surface 67A formed on the edge of the guide groove 67 guides the guided roll 27, so that the guide groove 67 guides the gripper 24 in a predetermined guide path.

In the present exemplary embodiment, the guide unit 60 guides the gripper 24 with (i) linear paths 61 and 63 extending along linearly-shaped paths 91 and 93 in which the chain 22 moves linearly and (ii) an arc path 62 extending along an arc-shaped path 92 in which the chain 22 rotates.

The path 92 is a path extending along a part of the outer periphery of the sprockets 37 and 25 in a portion where the chain 22 is wound around the sprockets 37 and 25. Specifically, the path 92 is a path extending along a part of a circumferential direction of pitch circles 37P and 25P of the sprockets 37 and 25.

The path 91 is a path connected to an upstream portion of the path 92 in the circulating direction C, and is a linearly-shaped path that advances toward the sprockets 37 and 25. The path 93 is a path connected to a downstream portion of the path 92 of the path 92 in the circulating direction C, and is a linearly-shaped path that goes away (separate) from the sprockets 37 and 25 and advances toward the sprockets 25 and 45. It can be said that the paths 91 and 93 are paths extending along the tangent lines of the sprockets 37 and 25 which are tangent to the pitch circles 37P and 25P.

The paths 91, 92, and 93 indicate a tracking path in which the center of the roller 77 (the pin 76) in the outer link 72 of the chain 22 moves. The linear paths 61 and 63 and the arc path 62 indicate a tracking path in which the center of the guided roll 27 moves.

In the present exemplary embodiment, the linear path 61 is offset from the path 91 to the downstream side in the circulating direction C. The arc path 62 is offset from the path 92 to the downstream side in the circulating direction C. The linear path 63 is offset from the path 93 to the downstream side in the circulating direction C.

Accordingly, an inflection point 6A between the linear path 61 and the arc path 62 is offset from an inflection point 9A between the path 91 and the path 92 to the downstream side in the circulating direction C. Further, an inflection point 6B between the arc path 62 and the linear path 63 is offset from an inflection point 9B between the path 92 and the path 93 to the downstream side in the circulating direction C.

The inflection point 6A is a position where the guided roll 27 is located when the fixing link 72X (specifically, the downstream roller 77Y) is located at the inflection point 9A. Further, the linear path 61 is not in direct contact with the arc path 62 at the inflection point 6A. Similarly, the inflection point 6B is a position where the guided roll 27 is located when the fixing link 72X (specifically, the downstream roller 77Y) is located at the inflection point 9B. Further, the linear path 63 is not in direct contact with the arc path 62 at the inflection point 6B.

Action According to the Present Exemplary Embodiment

In the image forming apparatus 10 according to the present exemplary embodiment, as illustrated in FIG. 4, the leading end portion of the recording medium P sent from the accommodating unit (not illustrated) that accommodates the recording media P is held by the gripper 24, upstream of the ejection position of the ejection units 14Y to 14K. Further, as the chain 22 circulates, the gripper 24 holding the leading end portion of the recording medium P moves in an arc shape conforming to the outer periphery of the sprocket 25 and the rotating body 50. Thus, the recording medium P is placed on the outer peripheral surface of the rotating body 50.

Then, the gripper 24 transports the recording medium by (a) performing a rotary movement along with the sprocket 25, the rotating body 50, and the chain 22 in a state of (i) holding the leading end portion of the recording medium P placed on the outer peripheral surface of the rotating body 50 and (ii) being located in the recess 54, and thereafter, (b) shifting to a linear movement along with the chain 22. Thus, an image is formed as the recording medium P passes through the ejection position of the ejection units 14Y to 14K and ink droplets are ejected from the ejection units 14Y to 14K to the recording medium P placed on the outer peripheral surface of the rotating body 50.

Figure 7:
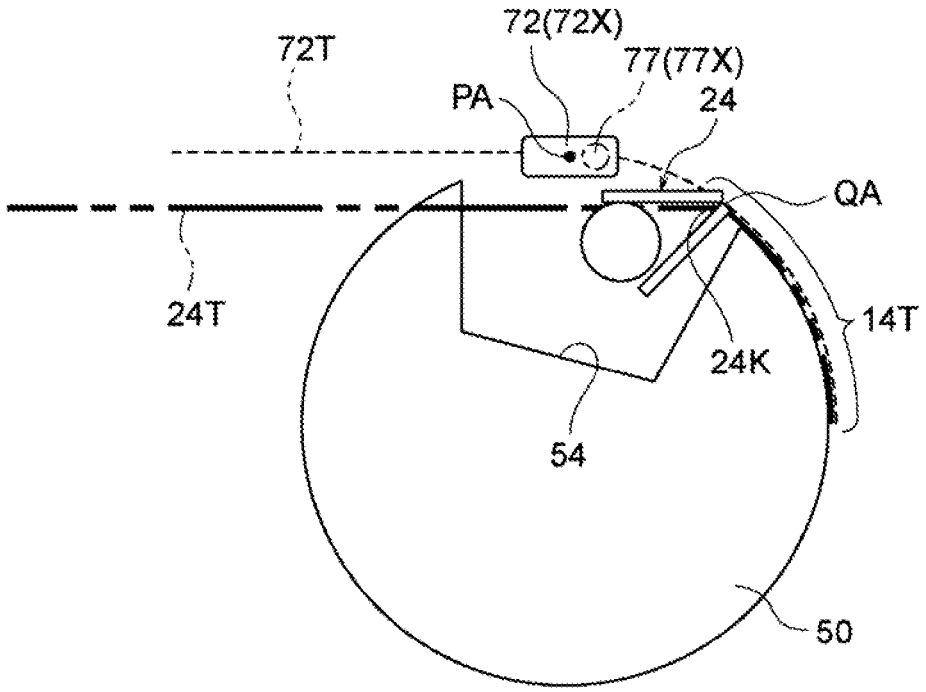
FIG. 7 is a schematic view illustrating a movement path of a holding position in a configuration in which the holding position is arranged upstream of an upstream roller of a fixing link.

Here, in a configuration in which the holding position 24K where the gripper 24 holds the recording medium P is arranged upstream of the upstream roller 77X of the fixing link 72X (hereinafter, referred to as a "configuration A"), this holding position 24K and the fixing link 72X move on the paths illustrated in FIG. 7. In FIG. 7, the path of this holding position 24K is indicated by a double chain line 24T, and the path of the fixing link 72X is indicated by a dashed line 72T (the same being applied to FIGS. 9 and 10). FIG. 7 is a conceptual diagram illustrating the paths of this holding position 24K and the fixing link 72X, and illustrates each part such as the fixing link 72X and the gripper 24 in a simplified manner (the same being applied to FIGS. 8A to 11C).

In the configuration A, as indicated by the dashed line 72T in FIG. 7, the fixing link 72X performs a rotary movement in an arc shape conforming to the outer periphery of the sprocket 25, and thereafter, shifts to a linear movement from a position PA illustrated in FIG. 7. The position PA is a position where the chain 22 begins to go away (separate) from the sprocket 25. An ejection position 14T of the ejection units 14Y to 14K is located upstream of the position PA.

Since the gripper 24 moves to follow the fixing link 72X, the holding position 24K performs a rotary movement in an arc shape conforming to the outer periphery of the sprocket 25, and thereafter, shifts to a linear movement from a position QA illustrated in FIG. 7. Thus, the holding position 24K shifts to a linear movement, upstream of the position PA.

Figure 8A:
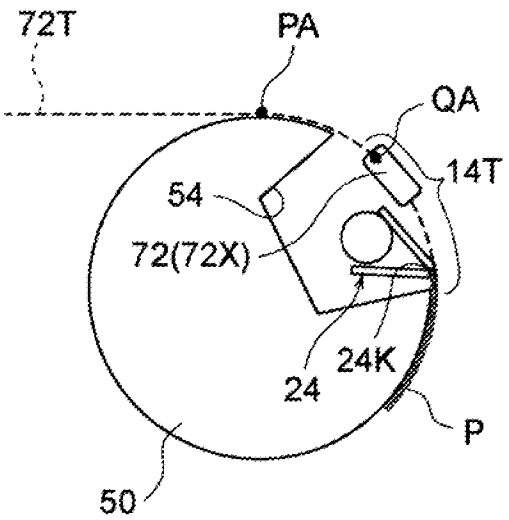
FIGS. 8A to 8C are operation diagrams in the configuration illustrated in FIG. 7.
Figure 8B:
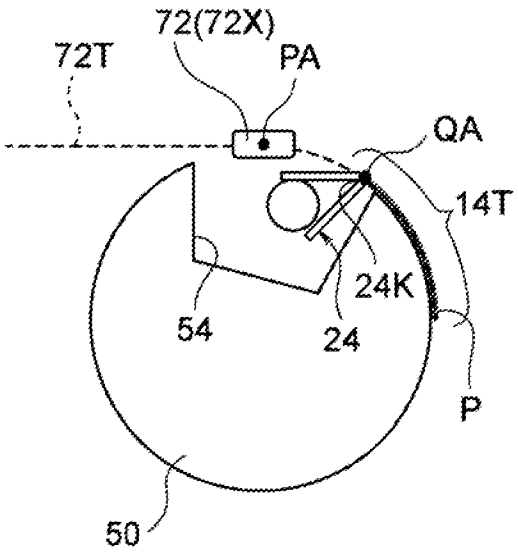
Figure 8C:
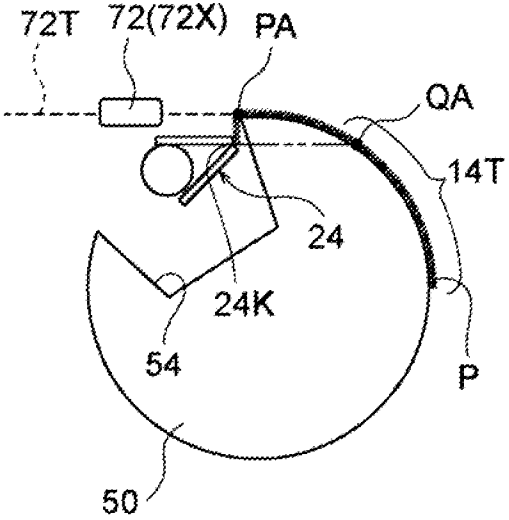

Therefore, in the configuration A, as illustrated in FIGS. 8A to 8C, the outer peripheral surface of the rotating body 50 on which the recording medium P is placed passes through the ejection position 14T of the ejection units 14Y to 14K to perform a rotary movement in an arc shape to the position PA, whereas the holding position 24K shifts to a linear movement at the position QA before reaching the position PA. Therefore, the gripper 24 may pull the recording medium P to move the recording medium P to the downstream side with respect to the outer peripheral surface of the rotating body 50, which results in the occurrence of image distortion.

On the other hand, in the image forming apparatus 10 according to the present exemplary embodiment, as described above, the holding position 24K where the gripper 24 holds the recording medium P is arranged downstream of the upstream roller 77X of the fixing link 72X (see FIG. 4). Specifically, in the present exemplary embodiment, the holding position 24K is arranged inside the outer edge of the downstream roller 77Y when viewed in the axial direction.

Figure 9:
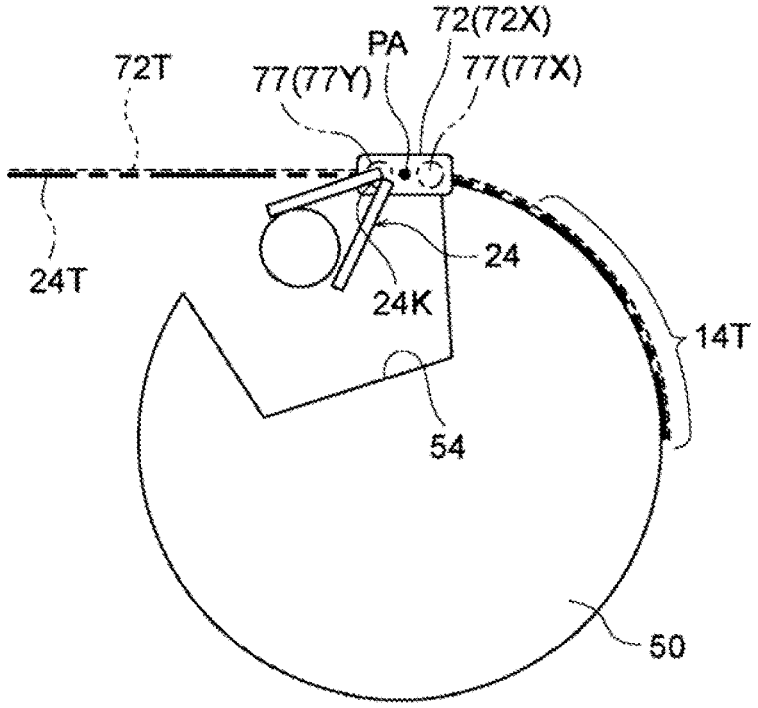
FIG. 9 is a schematic view illustrating a movement path of a holding position according to the first exemplary embodiment.

Therefore, this holding position 24K and the fixing link 72X move on the path illustrated in FIG. 9. In the present exemplary embodiment, similarly to the fixing link 72X, the holding position 24K performs a rotary movement in an arc shape conforming to the outer periphery of the sprocket 25, and thereafter, shifts to a linear movement from the position PA.

Thus, in the present exemplary embodiment, the holding position 24K performs a rotary movement in an arc shape to the position PA, and thereafter, shifts to a linear movement in synchronization with the outer peripheral surface of the rotating body 50 on which the recording medium P is placed passing through the ejection position 14T of the ejection units 14Y to 14K and performing a rotary movement in an arc shape to the position PA.

Further, in the present exemplary embodiment, the gripper 24 is fixed to the single outer link 72 by the fixing member 23. Here, in a configuration in which the gripper 24 is fixed to plural outer links 72 via the fixing member 23 (hereinafter, referred to as a "configuration B"), since the posture of the gripper 24 will vary under the influence of the posture of each of the plural outer links 72, the posture of the gripper 24 is likely to vary.

Modification of Holding Position 24K

In the present exemplary embodiment, the holding position 24K is arranged inside the outer edge of the downstream roller 77Y when viewed in the axial direction, but the disclosure is not limited to this. For example, the holding position 24K may be arranged outside the outer edge of the downstream roller 77Y and may be arranged in the region extending from the upstream roller 77X to the downstream roller 77Y of the fixing link 72X. Further, as illustrated in FIGS. 10 to 11C, the holding position 24K may be arranged downstream of the downstream roller 77Y (hereinafter referred to as a "configuration C"), and may only have to be arranged downstream of the upstream roller 77X of the fixing link 72X.

Figure 10:
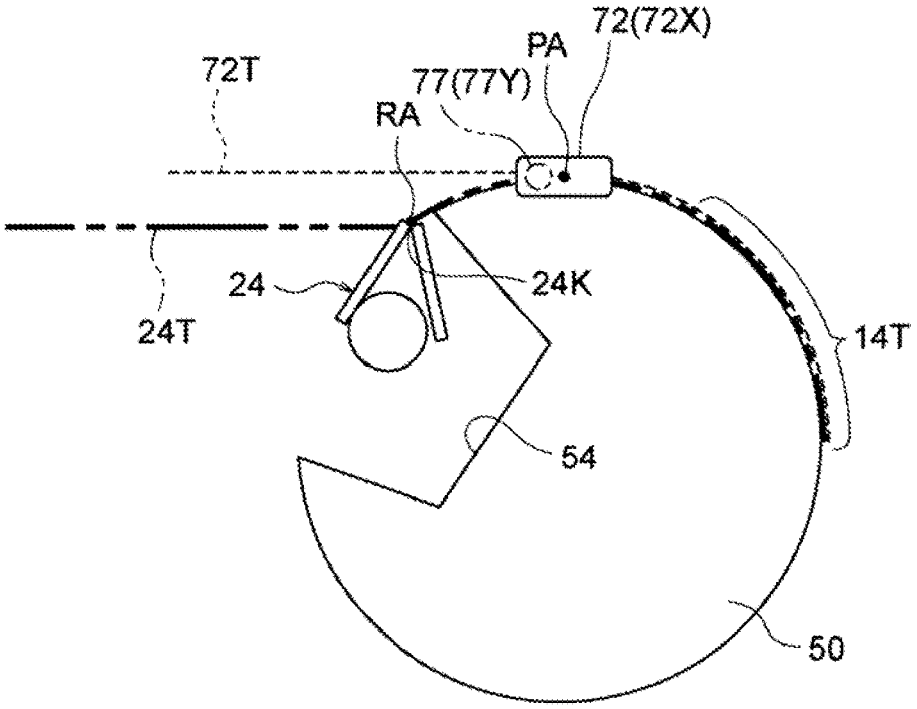
FIG. 10 is a schematic view illustrating a movement path of a holding position in a configuration in which the holding position is arranged downstream of a downstream roller.

In the configuration C, according to the present exemplary embodiment, the holding position 24K performs a rotary movement in an arc shape conforming to the outer periphery of the sprocket 25, and thereafter, shifts to a linear movement from a position RA illustrated in FIG. 10. Thus, the holding position 24K shifts to a linear movement, downstream of the position PA.

Figure 11A:
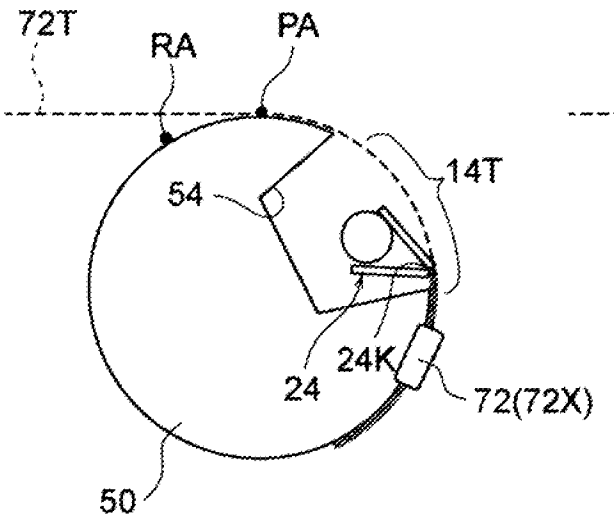
FIGS. 11A to 11C are operation diagrams in the configuration illustrated in FIG. 10.
Figure 11B:
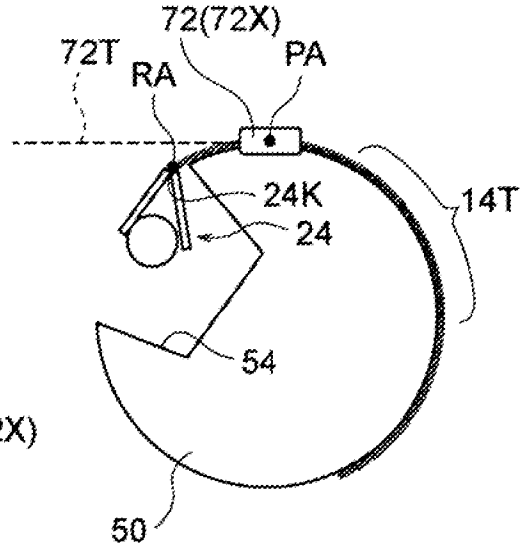
Figure 11C:
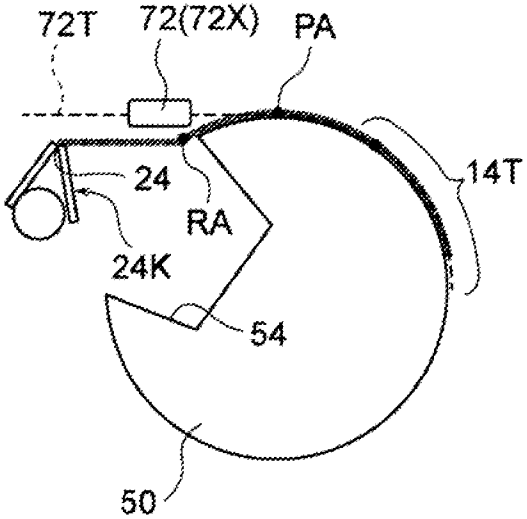

Therefore, in the configuration C, as illustrated in FIGS. 11A to 11C, the outer peripheral surface of the rotating body 50 on which the recording medium P is placed passes through the ejection position 14T of the ejection units 14Y to 14K to perform a rotary movement in an arc shape to the position PA, whereas the holding position 24K shifts to a linear movement to the position RA after passing through the position PA. Therefore, sagging occurs in the recording medium P held at the leading end portion thereof by the gripper 24

Action by Guide Unit 60

Next, actions by the guide unit 60 will be described.

In the present exemplary embodiment, since the gripper 24 is supported by the single fixing link 72X and the holding position 24K is arranged downstream of the upstream roller 77X of the fixing link 72X, each part of the gripper 24 is biased to the downstream side. Therefore, the center of gravity 24J of the gripper 24 is located at a position separated from the fixing link 72X that supports the gripper 24 to the downstream side (see FIG. 4).

Here, in a configuration in which the gripper 24 is moved according to the circumstances without having the guide unit 60 (hereinafter, referred to as a "configuration D"), the center of gravity 24J of the gripper 24 is arranged at a position separated from the fixing link 72X to the downstream side, such that a rotational moment acts in the direction of the arrow F about the fixing link 72X (specifically, the center of the downstream roller 77Y) as a fulcrum. Thus, the gripper 24 is likely to tilt, and the posture of the gripper 24 is likely to vary.

On the other hand, in the present exemplary embodiment, as described above, the guide unit 60 guides the gripper 24 with (i) the linear paths 61 and 63 extending along the linearly-shaped paths 91 and 93 in which the chain 22 moves linearly and (ii) the arc path 62 extending along the arc-shaped path 92 in which the chain 22 rotates (see FIG. 6).

Further, in the present exemplary embodiment, the linear path 61 is offset from the path 91 to the downstream side in the circulating direction C. The arc path 62 is offset from the path 92 to the downstream side in the circulating direction C. The linear path 63 is offset from the path 93 to the downstream side in the circulating direction C.

Therefore, the guide unit 60 guides the gripper 24 while supporting a portion of the gripper 24 which is offset to the downstream side in the circulating direction C with respect to the fixing link 72X, that is, a portion of the gripper 24 (specifically, the guided roll 27) that is closer to the center of gravity 24J than the fixing link 72X.

Modification of Guide Unit 60

Figure 12:
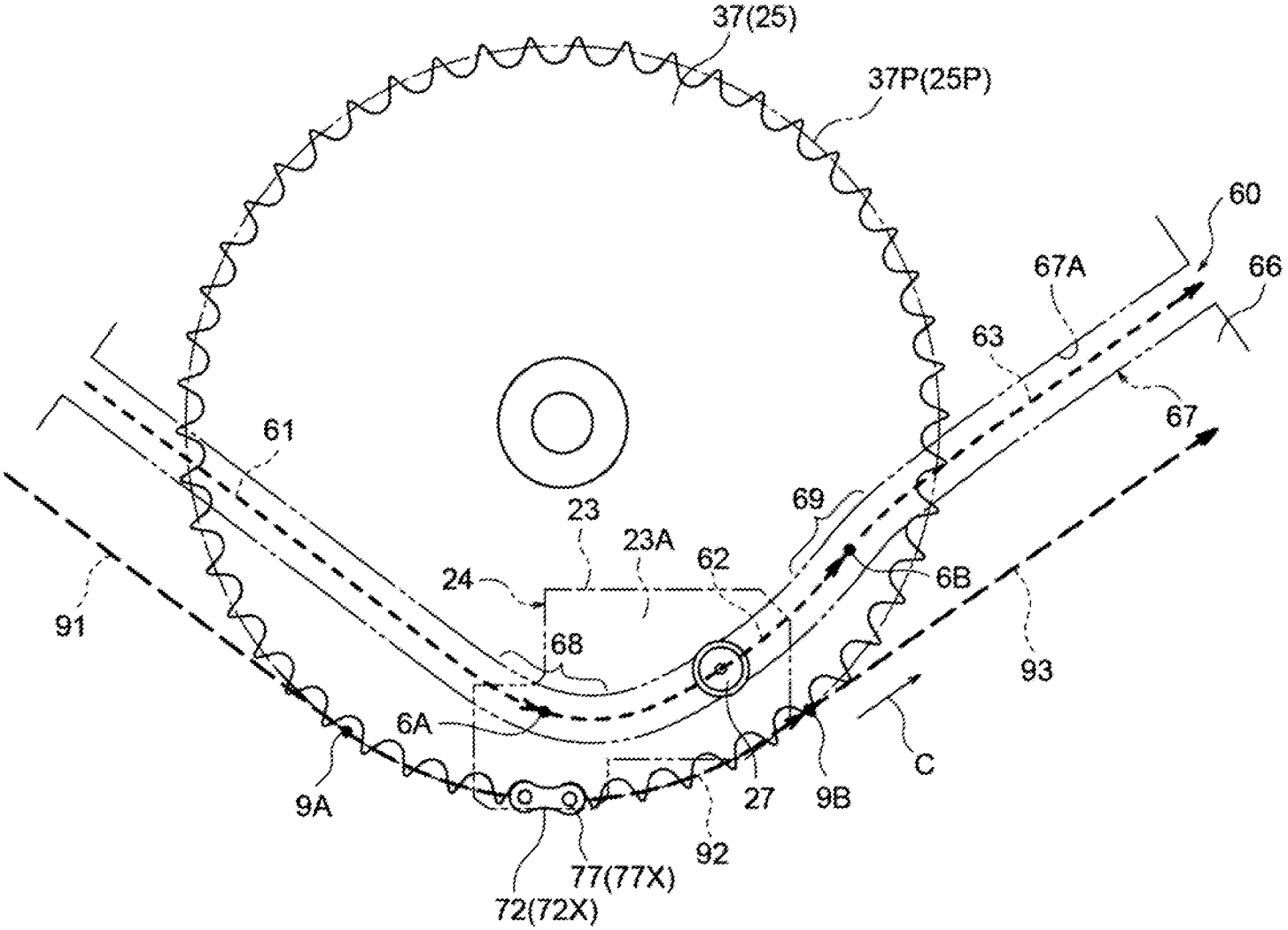
FIG. 12 is a side view illustrating a guide unit according to a modification.

In a modification, as illustrated in FIG. 12, the guide unit 60 guides the gripper 24 so that the gripper 24 moves in a curved manner at the inflection point 6A between the linear path 61 and the arc path 62 and at the inflection point 6B between the arc path 62 and the linear path 63.

That is, in the modification, the linear path 61 and the arc path 62 are connected at a curved path 68 that causes the gripper 24 to move in a curved manner, and the arc path 62 and the linear path 63 are connected at a curved path 69 that causes the gripper 24 to move in a curved manner.

Further, in the modification, the curved paths 68 and 69 are arranged at positions other than a position where the gripper 24 passes or receives the recording medium P and a position, on the rotating body 50, where processing for the recording medium P is executed.

In the modification, in the arc path 62 (that is, the region between the curved path 68 and the curved path 69) in the sprocket 37, the gripper 24 passes the recording medium P.

Further, in the modification, the gripper 24 receives the recording medium P at a portion of the sprocket 25 downstream of the linear path 63. Furthermore, in the modification, as the processing for the recording medium P on the rotating body 50, ink ejection processing to the recording medium P by the ejection units 14Y to 14K is performed in the arc path 62 (that is, the region between the curved path 68 and the curved path 69) in the sprocket 25.

Accordingly, in the modification, in the curved paths 68 and 69, the gripper 24 does not pass or receive the recording medium P, and no ink ejection processing for the recording medium P is executed.

Figure 13:
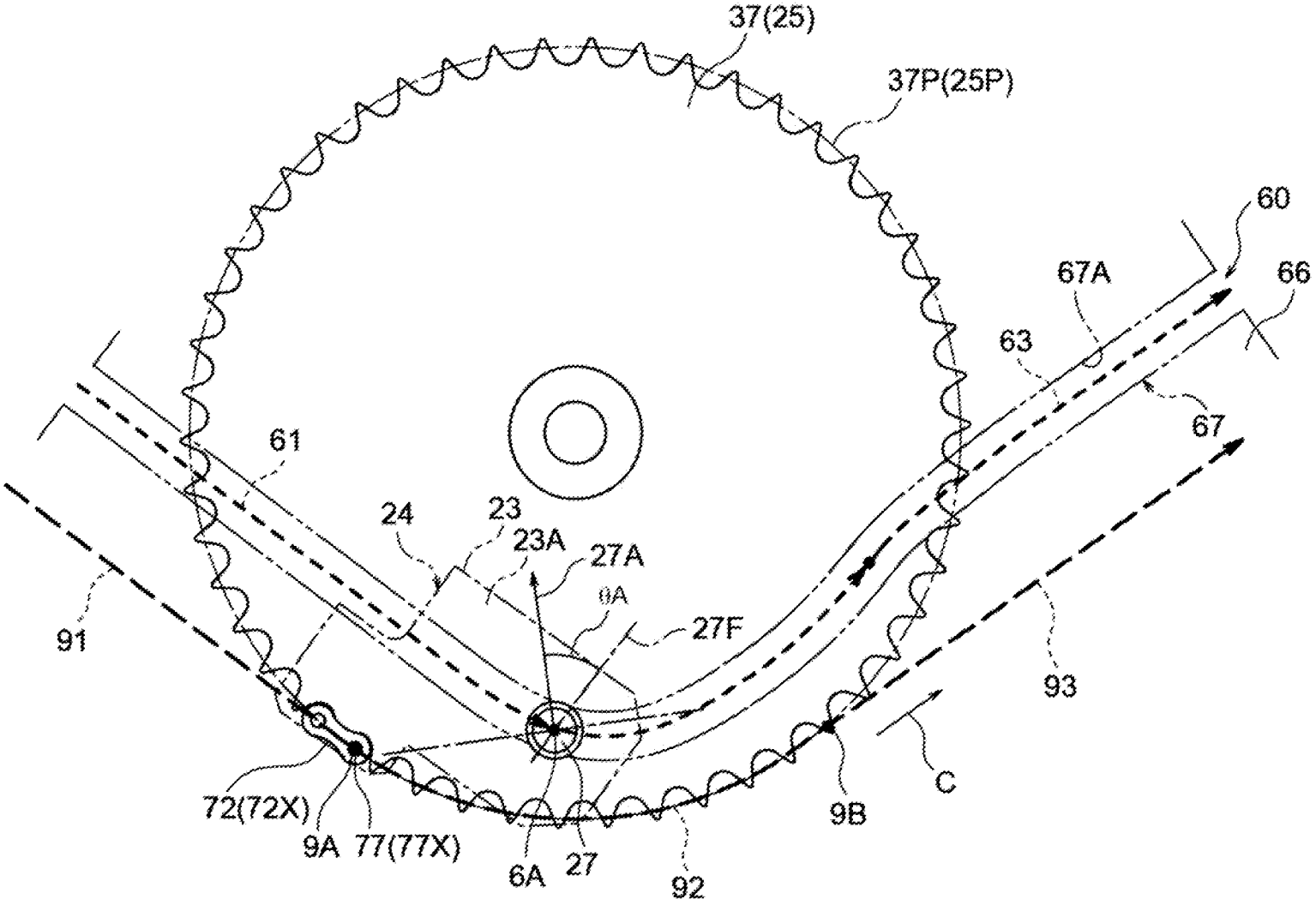
FIG. 13 is a side view illustrating the guide unit according to the modification.

Furthermore, in the modification, as illustrated in FIG. 13, the curved path 68 has a curvature such that a pressure angle θA, at the inflection point 6A, between the curved path 68 and the guided roll 27 is 45° or less. The pressure angle θA is an angle between the swing direction (the arrow 27A in FIG. 13) of the guided roll 27 and the perpendicular line 27F to the guide surface 67A. The swing direction (the arrow 27A in FIG. 13) of the guided roll 27 is the direction in which the guided roll 27 swings from the center of the downstream roller 77Y. The guided roll 27 swings to the center of the downstream roller 77Y.

In a general cam, 45° is used as the maximum pressure angle of a swing follower that allows the cam to be smoothly movable. According to this, in the present exemplary embodiment, the pressure angle is set to 45° or less.

In the present modification, as described above, the guide unit 60 guides the gripper 24 so that the gripper 24 moves in a curved manner at the inflection point 6A between the linear path 61 and the arc path 62 and at the inflection point 6B between the arc path 62 and the linear path 63.

Further, in the modification, as described above, the curved paths 68 and 69 are arranged at positions other than (i) a position where the gripper 24 passes or receives the recording medium P and (ii) a position, on the rotating body 50, where processing for the recording medium P is executed.

Furthermore, in the modification, as described above, the curved path 68 has a curvature such that the pressure angle θA, at the inflection point 6A, between the curved path 68 and the guided roll 27 is 45° or less.

In the image forming apparatus 200 of an electrophotographic type (which will be described later), the processing for the recording medium P may be transfer processing or fixing processing.

Other Modifications

In the present exemplary embodiment, the gripper 24 is fixed to the single outer link 72 by the fixing member 23, but the disclosure is not limited to this. For example, the gripper 24 may be fixed to plural outer links 72 by the fixing member 23. In this configuration, the holding position 24K is arranged downstream of the upstream roller 77X of the most downstream link in the circulating direction C among the plural outer links 72 to which the gripper 24 is fixed.

Further, in the present exemplary embodiment, the guide unit 60 guides the gripper 24 with (i) the linear paths 61 and 63 extending along the linearly-shaped paths 91 and 93 in which the chain 22 moves linearly and (ii) the arc path 62 extending along the arc-shaped path 92 in which the chain 22 rotates, but the disclosure is not limited to this. For example, the transport mechanism 12 may be configured to move the gripper 24 according to the circumstances without having the guide unit 60.

Further, as described above, the guide unit 60 according to the modification guides the gripper 24 so that the gripper 24 moves in a curved manner at the inflection point 6A between the linear path 61 and the arc path 62 and at the inflection point 6B between the arc path 62 and the linear path 63, but the disclosure is not limited to this. For example, the gripper 24 may be configured to bend and move at the inflection points 6A and 6B.

Further, in the guide unit 60 according to the modification, the curved paths 68 and 69 are arranged at positions other than (i) a position where the gripper 24 passes or receives the recording medium P and (ii) a position, on the rotating body 50, where processing for the recording medium P is executed, but the disclosure is not limited to this. For example, the curved paths 68 and 69 may be arranged at either of the position where the gripper 24 passes or receives the recording medium P and the position where the processing for the recording medium P is executed.

Further, in the guide unit 60 according to the modification, the curved path 68 has a curvature such that the pressure angle θA, at the inflection point 6A, between the curved path 68 and the guided roll 27 is 45° or less, but the disclosure is not limited to this. For example, the curved path 68 may have a curvature such that the pressure angle exceeds 45°.

In the present exemplary embodiment, the gripper 24 holds the leading end portion of the recording medium P by sandwiching it therebetween, but the disclosure is not limited to this. An exemplary holder may be configured to hold the leading end portion of the recording medium P by, for example, an air suction force or an adhesive force.

Second Exemplary Embodiment

Image Forming Apparatus 200

Figure 14:
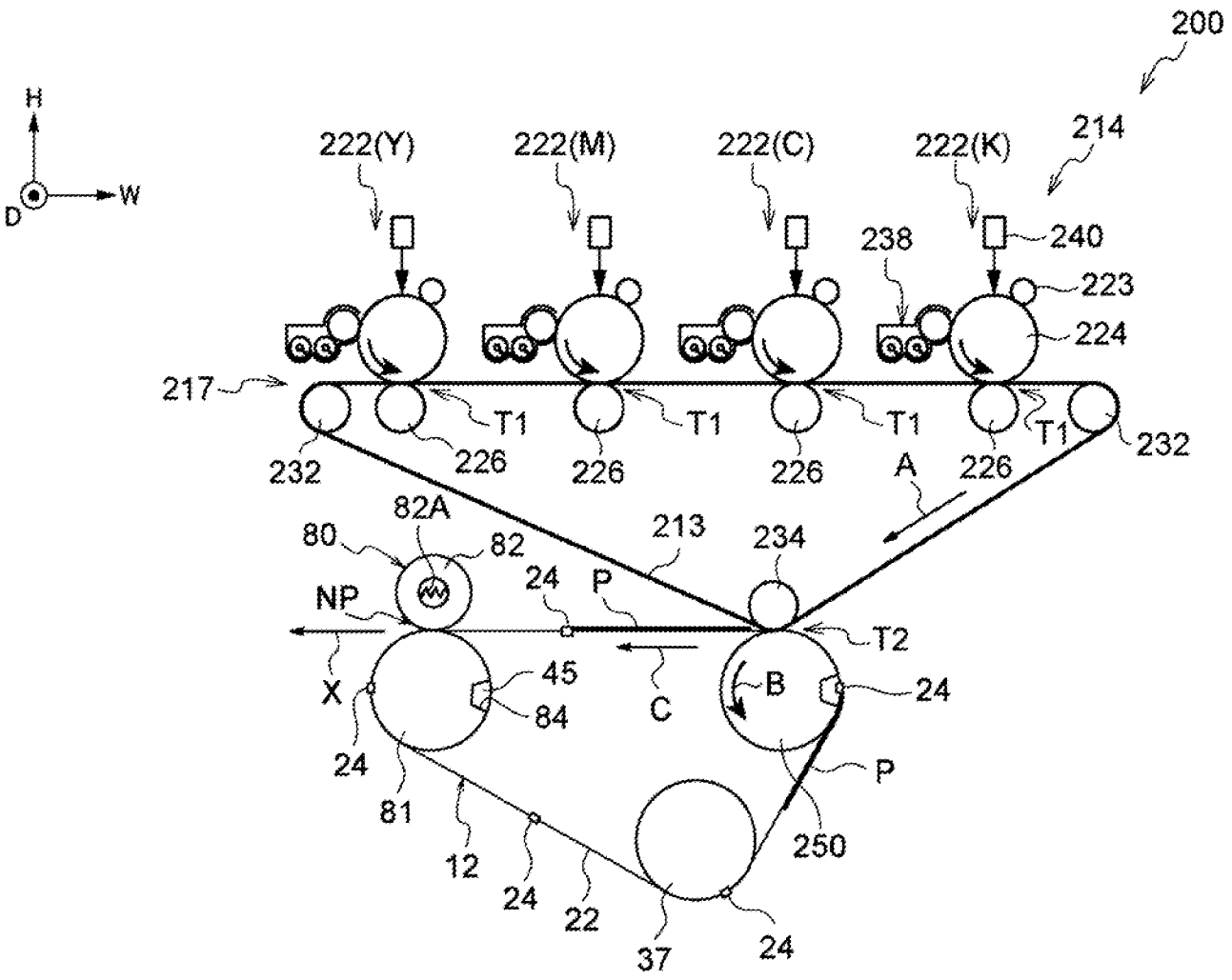
FIG. 14 is a schematic view illustrating a configuration of an image forming apparatus according to a second exemplary embodiment.

In the first exemplary embodiment, the image forming apparatus 10 is an inkjet type image forming apparatus that forms an image using an ink on the recording medium P, but the image forming apparatus is not limited to this. For example, an exemplary image forming apparatus may be an electrophotographic type image forming apparatus or any other apparatus that forms an image. In the second exemplary embodiment, the electrophotographic type image forming apparatus 200 will be described. FIG. 14 is a schematic view illustrating a configuration of the image forming apparatus 200 according to the present exemplary embodiment. Parts having the same functions as in the first exemplary embodiment will be designated by the same reference numerals, and the description thereof will be omitted as appropriate.

Image Forming Unit 214

The image forming apparatus 200 includes an image forming unit 214 instead of the image forming unit 14. The image forming unit 214 has a function of forming a toner image (an example of an image) on the recording medium P by an electrophotographic method. More specifically, as illustrated in FIG. 14, the image forming unit 214 includes a toner image forming unit 222 which forms the toner image and a transfer device 217 which transfers the toner image formed in the toner image forming unit 222 to the recording medium P.

Toner Image Forming Unit 222

The toner image forming unit 222 illustrated in FIG. 14 is provided in a plural number so as to form a toner image for each color. In the present exemplary embodiment, toner image forming units 222 of a total of four colors including yellow (Y), magenta (M), cyan (C), and black (K) are provided. (Y), (M), (C), and (K) illustrated in FIG. 14 indicate components corresponding to the above respective colors.

Since the toner image forming unit 222 of each color is configured similarly except a toner used therein, on behalf of the toner image forming unit 222 of each color, each part of the toner image forming unit 222(K) in FIG. 14 is designated by a reference numeral.

Specifically, the toner image forming unit 222 of each color has a photoconductor 224 which rotates in one direction (for example, the counterclockwise direction in FIG. 14). Further, the toner image forming unit 222 of each color includes a charger 223, an exposure device 240, and a developing device 238.

In the toner image forming unit 222 of each color, the charger 223 charges the photoconductor 224. Furthermore, the exposure device 240 exposes the photoconductor 224 charged by the charger 223 to form an electrostatic latent image on the photoconductor 224. Further, the developing device 238 develops the electrostatic latent image formed on the photoconductor 224 by the exposure device 240 to form a toner image.

Transfer Device 217

The transfer device 217 illustrated in FIG. 14 is a device that transfers the toner image formed in the toner image forming unit 222 to the recording medium P. Specifically, the transfer device 217 primarily transfers the toner image on the photoconductor 224 of each color so as to be superimposed on a transfer belt 213 as an intermediate transfer body, and secondarily transfers the superimposed toner image to the recording medium P. As illustrated in FIG. 14, the transfer device 217 includes the transfer belt 213, a primary transfer roller 226, and a transfer body 250.

The primary transfer roller 226 is a roll that transfers the toner image on the photoconductor 224 of each color to the transfer belt 213 at a primary transfer position T1 between the photoconductor 224 and the primary transfer roller 226. In the present exemplary embodiment, as a primary transfer electric field is applied between the primary transfer roller 226 and the photoconductor 224, the toner image formed on the photoconductor 224 is transferred to the transfer belt 213 at the primary transfer position T1.

The toner image from the photoconductor 224 of each color is transferred to the outer peripheral surface of the transfer belt 213. As illustrated in FIG. 14, the transfer belt 213 is wound around plural rollers 232 and an opposing roller 234 so as to define an endless shape and to have an inverted triangle posture when viewed from the front (when viewed in the apparatus depth direction). The transfer belt 213 circulates in the direction of the arrow A as at least one of the plural rollers 232 is rotationally driven.

The transfer body 250 is a roll that transfers the toner image transferred to the transfer belt 213 to the recording medium P at a secondary transfer position T2 between the opposing roller 234 and the transfer body 250. In the present exemplary embodiment, as a secondary transfer electric field is applied between the opposing roller 234 and the transfer body 250, the toner image transferred to the transfer belt 213 is transferred to the recording medium P at the secondary transfer position T2. The transfer body 250 is configured similarly to the rotating body 50 in the first exemplary embodiment, and is an example of a rotating body.

Fixing Device 80

In the present exemplary embodiment, the fixing device 80 functions as a device that fixes the toner image transferred to the recording medium P by the transfer body 250 to the recording medium P. Specifically, the fixing device 80 has a pressure roller 81 and a heating roller 82, as illustrated in FIG. 14.

The pair of sprockets 45 in the first exemplary embodiment are provided on both end sides of the pressure roller 81 in the axial direction. This pair of sprockets 45 are arranged coaxially with the pressure roller 81, and are configured to rotate integrally with the pressure roller 81. Further, a recess 84 in which the gripper 24 and the fixing member 23 are accommodated is formed in the outer periphery of the pressure roller 81.

In the fixing device 80, the heating roller 82 is disposed on the upper side of the pressure roller 81. The heating roller 82 has a heating source 82A such as a halogen lamp therein.

Furthermore, in the fixing device 80, for example, one of the pressure roller 81 and heating roller 82 is a rotationally driving roll, and the other of the pressure roller 81 and the heating roller 82 is a rotationally driven roll. Both the pressure roller 81 and the heating roller 82 may be rotationally driving rollers.

Then, the fixing device 80 fixes the toner image transferred to the recording medium P on the recording medium P by applying heat and pressure to the recording medium P while transporting the recording medium P in a state where the recording medium P is sandwiched between the heating roller 82 and the pressure roller 81.

In the image forming apparatus 200, as the chain 22 circulates the circulating direction C in a state where the gripper 24 holds the leading end portion of the recording medium P, the transport mechanism 12 passes the recording medium P through the secondary transfer position T2 and a fixing position NP between the pressure roller 81 and the heating roller 82. Then, the toner image which has been primarily transferred so as to be superimposed on the transfer belt 213 at the primary transfer position T1 of each color is secondarily transferred to the recording medium P at the secondary transfer position T2. The toner image secondarily transferred to the recording medium P is fixed on the recording medium P at the fixing position NP.

The transport mechanism 12 and the guide unit 60 in the present exemplary embodiment are configured similarly to the transport mechanism 12 and the guide unit 60 in the first exemplary embodiment, and the present exemplary embodiment exerts the same actions as in the first exemplary embodiment.

The present disclosure is not limited to the above exemplary embodiments, and various modifications, changes, and improvements are possible without departing from the gist thereof. For example, plural ones of the above-mentioned modifications may be combined as appropriate.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a rotating body having a recess in an outer peripheral surface thereof;

a sprocket provided coaxially with the rotating body to rotate integrally with the rotating body;

a chain having a plurality of links, the chain being wound around the sprocket to circulate in a circulating direction so as to shift from a rotary movement in which the chain rotates in an arc shape conforming to an outer periphery of the sprocket along with the sprocket, to a linear movement;

a holder fixed to at least one link of the links of the chain, the holder being configured to hold a leading end portion of a recording medium, the holder being configured to transport the recording medium by performing the rotary movement along with the rotating body and the chain in a state of (i) holding the leading end portion of the recording medium placed on the outer peripheral surface of the rotating body and (ii) being located in the recess, and then shifting to the linear movement along with the chain; and an image forming unit configured to form an image on the recording medium placed on the outer peripheral surface of the rotating body, wherein a holding position where the holder holds the recording medium is arranged downstream of an upstream roller of rollers of a most downstream link in the circulating direction among the at least one link to which the holder is fixed, and a distance from a most upstream portion of the holding position is to a downstream roller of the rollers of the most downstream link is shorter than a distance of the most upstream portion from the upstream roller.

2. The image forming apparatus according to claim 1, wherein the holding position is arranged in a region extending from the upstream roller of the most downstream link to a downstream roller of the rollers of the most downstream link in the circulating direction.

3. The image forming apparatus according to claim 2, wherein the holding position is arranged inside an outer edge of the downstream roller when viewed in an axial direction.

4. The image forming apparatus according to claim 3, wherein the at least one link to which the holder is fixed includes no more than one link, and the holding position is arranged downstream of the upstream roller of the link.

5. The image forming apparatus according to claim 3, further comprising:

a guide unit configured to guide the holder with (i) a linear path extending along a linearly-shaped path in which the chain moves linearly and (ii) an arc path extending along an arc-shaped path in which the chain rotates.

6. The image forming apparatus according to claim 2, wherein the at least one link to which the holder is fixed includes no more than one link, and the holding position is arranged downstream of the upstream roller of the link.

7. The image forming apparatus according to claim 6, further comprising:

a guide unit configured to guide the holder with (i) a linear path extending along a linearly-shaped path in which the chain moves linearly and (ii) an arc path extending along an arc-shaped path in which the chain rotates.

8. The image forming apparatus according to claim 2, further comprising:

a guide unit configured to guide the holder with (i) a linear path extending along a linearly-shaped path in which the chain moves linearly and (ii) an arc path extending along an arc-shaped path in which the chain rotates.

9. The image forming apparatus according to claim 1, wherein the at least one link to which the holder is fixed includes no more than one link, and the holding position is arranged downstream of the upstream roller of the link.

10. The image forming apparatus according to claim 9, further comprising:

a guide unit configured to guide the holder with (i) a linear path extending along a linearly-shaped path in which the chain moves linearly and (ii) an arc path extending along an arc-shaped path in which the chain rotates.

11. The image forming apparatus according to claim 1, further comprising:

a guide unit configured to guide the holder with (i) a linear path extending along a linearly-shaped path in which the chain moves linearly and (ii) an arc path extending along an arc-shaped path in which the chain rotates.

12. The image forming apparatus according to claim 11, wherein the guide unit is configured to guide the holder such that the holder moves in a curved manner at an inflection point between the linear path and the arc path.

13. The image forming apparatus according to claim 12, wherein a curved path that causes the holder to move in the curved manner is arranged at a position other than (i) a position where the holder passes or receives the recording medium and (ii) a position, on the rotating body, where processing for the recording medium is executed.

14. The image forming apparatus according to claim 12, wherein a curved path that causes the holder to move in the curved manner has a curvature such that a pressure angle between the curved path and a guided roll that is guided with the curved path is 45° or less.

15. The image forming apparatus according to claim 11, wherein the linear path is offset from the linearly-shaped path in which the chain moves linearly to a downstream side in the circulating direction, and the arc path is offset from the arc-shaped path in which the chain rotates to the downstream side in the circulating direction.

16. An image forming apparatus comprising:

a rotating body having a recess in an outer peripheral surface thereof;

a sprocket provided coaxially with the rotating body to rotate integrally with the rotating body;

a chain having a plurality of links, the chain being wound around the sprocket to circulate in a circulating direction so as to shift from a rotary movement in which the chain rotates in an arc shape conforming to an outer periphery of the sprocket along with the sprocket, to a linear movement;

a holder fixed to at least one link of the links of the chain, the holder being configured to hold a leading end portion of a recording medium, the holder being configured to transport the recording medium by performing the rotary movement along with the rotating body and the chain in a state of (i) holding the leading end portion of the recording medium placed on the outer peripheral surface of the rotating body and (ii) being located in the recess, and then shifting to the linear movement along with the chain; and a guide unit configured to guide the holder with (i) a linear path extending along a linearly-shaped path in which the chain moves linearly and (ii) an arc path extending along an arc-shaped path in which the chain rotates, wherein the linear path is offset from the linearly-shaped path in which the chain moves linearly to a downstream side in the circulating direction, and the arc path is offset from the arc-shaped path in which the chain rotates to the downstream side in the circulating direction.

17. The image forming apparatus according to claim 16, wherein the guide unit is configured to guide the holder such that the holder moves in a curved manner at an inflection point between the linear path and the arc path.

18. The image forming apparatus according to claim 17, wherein a curved path that causes the holder to move in the curved manner is arranged at a position other than (i) a position where the holder passes or receives the recording medium and (ii) a position, on the rotating body, where processing for the recording medium is executed.

19. The image forming apparatus according to claim 17, wherein a curved path that causes the holder to move in the curved manner has a curvature such that a pressure angle between the curved path and a guided roll that is guided with the curved path is 45° or less.

* * * * *